US010535314B2

(12) United States Patent
Zhang

(10) Patent No.: US 10,535,314 B2
(45) Date of Patent: Jan. 14, 2020

(54) METHOD FOR CHANGING DISPLAY MODE OF LIQUID CRYSTAL SCREEN AND LCD PROJECTION DEVICE USING THE METHOD

(71) Applicant: LUXNPRO CHENGDU ELECTRONICS CO., LTD., Chengdu (CN)

(72) Inventor: Jin Zhang, Chengdu (CN)

(73) Assignee: LUXNPRO CHENGDU ELECTRONICS CO., LTD., Chengdu (CN)

( * ) Notice: Subject to any disclaimer, the term of this patent is extended or adjusted under 35 U.S.C. 154(b) by 57 days.

(21) Appl. No.: 15/990,198

(22) Filed: May 25, 2018

(65) Prior Publication Data

US 2019/0304389 A1 Oct. 3, 2019

(30) Foreign Application Priority Data

Apr. 2, 2018 (CN) ..... 2018 1 0284879

(51) Int. Cl.

| | |
|---|---|
| ***G09G 3/36*** | (2006.01) |
| ***G09G 3/00*** | (2006.01) |
| ***G09G 5/38*** | (2006.01) |

(52) U.S. Cl.

CPC ..... *G09G 3/3618* (2013.01); *G09G 3/002* (2013.01); *G09G 5/38* (2013.01); *G09G 2310/08* (2013.01); *G09G 2320/0247* (2013.01); *G09G 2340/0492* (2013.01); *G09G 2350/00* (2013.01); *G09G 2370/00* (2013.01)

(58) Field of Classification Search

CPC ..... G09G 3/3618; G09G 3/002; G09G 5/36; G09G 2310/08; G09G 2320/0247; G09G 2340/0492; G09G 2350/00; G09G 2370/00

See application file for complete search history.

(56) References Cited

U.S. PATENT DOCUMENTS

2018/0024798 A1* 1/2018 Zou ..... G06F 3/14 715/864

* cited by examiner

*Primary Examiner* — Michael Pervan

(57) ABSTRACT

The present disclosure discloses a method for changing a landscape signal of a liquid crystal screen to a portrait mode. The method comprises: adjusting the setting of a built-in driving TCON (time controller) IC (chipset) of the LCD so as to change the input signal interface of the LCD from an MIPI (mobile industry processor interface) to a TTL (transistor-transistor level) data/timing interface+SPI (serial peripheral interface) command control interface; controlling the initialization, turning-on and turning-off of the driving TCON IC via the SPI interface, and realizing the switching among four projection modes, desktop front projection, desktop rear projection, ceiling front projection, and ceiling rear projection, by adjusting the up, down, left and right display directions of a screen output image; receiving, in real time, the landscape image outputted by a front-end video processing chip through the TTL data interface, and then displaying same in real time.

8 Claims, 1 Drawing Sheet

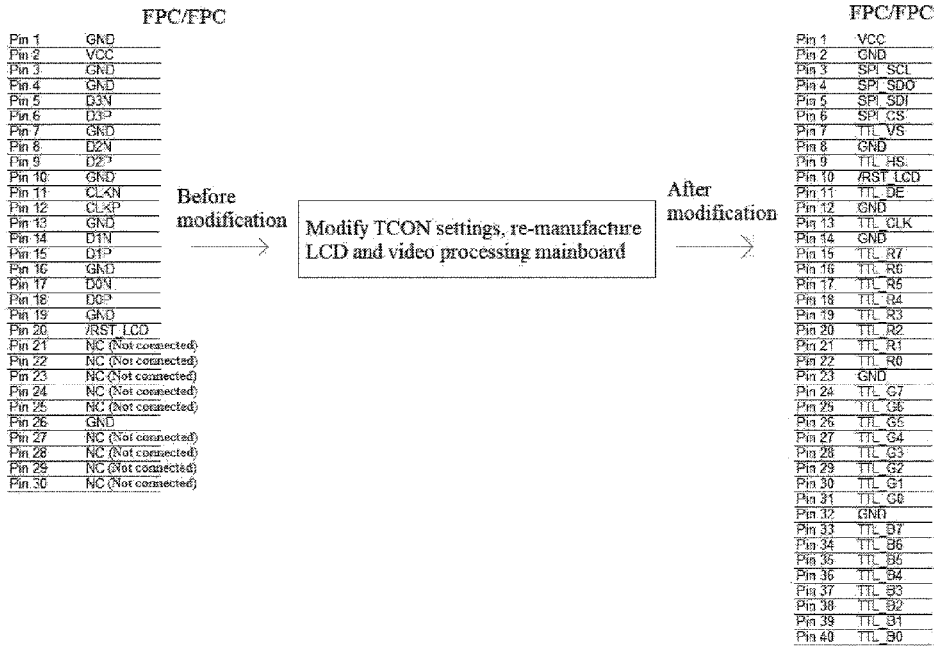

FPC/FPC

| | |
|---|---|
| Pin 1 | GND |
| Pin 2 | VCC |
| Pin 3 | GND |
| Pin 4 | GND |
| Pin 5 | D3N |
| Pin 6 | D3P |
| Pin 7 | GND |
| Pin 8 | D2N |
| Pin 9 | D2P |
| Pin 10 | GND |
| Pin 11 | CLKN |
| Pin 12 | CLKP |
| Pin 13 | GND |
| Pin 14 | D1N |
| Pin 15 | D1P |
| Pin 16 | GND |
| Pin 17 | D0N |
| Pin 18 | D0P |
| Pin 19 | GND |
| Pin 20 | /RST_LCD |
| Pin 21 | NC (Not connected) |
| Pin 22 | NC (Not connected) |
| Pin 23 | NC (Not connected) |
| Pin 24 | NC (Not connected) |
| Pin 25 | NC (Not connected) |
| Pin 26 | GND |
| Pin 27 | NC (Not connected) |
| Pin 28 | NC (Not connected) |
| Pin 29 | NC (Not connected) |
| Pin 30 | NC (Not connected) |

Before modification →

Modify TCON settings, re-manufacture LCD and video processing mainboard

After modification →

FPC/FPC

| | |
|---|---|
| Pin 1 | VCC |
| Pin 2 | GND |
| Pin 3 | SPI_SCL |
| Pin 4 | SPI_SDO |
| Pin 5 | SPI_SDI |
| Pin 6 | SPI_CS |
| Pin 7 | TTL_VS |
| Pin 8 | GND |
| Pin 9 | TTL_HS |
| Pin 10 | /RST_LCD |
| Pin 11 | TTL_DE |
| Pin 12 | GND |
| Pin 13 | TTL_CLK |
| Pin 14 | GND |
| Pin 15 | TTL_R7 |
| Pin 16 | TTL_R6 |
| Pin 17 | TTL_R5 |
| Pin 18 | TTL_R4 |
| Pin 19 | TTL_R3 |
| Pin 20 | TTL_R2 |
| Pin 21 | TTL_R1 |
| Pin 22 | TTL_R0 |
| Pin 23 | GND |
| Pin 24 | TTL_G7 |
| Pin 25 | TTL_G6 |
| Pin 26 | TTL_G5 |
| Pin 27 | TTL_G4 |
| Pin 28 | TTL_G3 |
| Pin 29 | TTL_G2 |
| Pin 30 | TTL_G1 |
| Pin 31 | TTL_G0 |
| Pin 32 | GND |
| Pin 33 | TTL_B7 |
| Pin 34 | TTL_B6 |
| Pin 35 | TTL_B5 |
| Pin 36 | TTL_B4 |
| Pin 37 | TTL_B3 |
| Pin 38 | TTL_B2 |
| Pin 39 | TTL_B1 |
| Pin 40 | TTL_B0 |

METHOD FOR CHANGING DISPLAY MODE OF LIQUID CRYSTAL SCREEN AND LCD PROJECTION DEVICE USING THE METHOD

CROSS-REFERENCE TO RELATED APPLICATIONS

This application is based upon and claims priority of Chinese Patent Application No. 201810284879.5, filed before Chinese Patent Office on Apr. 2, 2018 and entitled "METHOD FOR CHANGING DISPLAY MODE OF LIQUID CRYSTAL SCREEN AND LCD PROJECTION DEVICE USING THE METHOD," the entire contents of which is incorporated herein by reference.

TECHNICAL FIELD

The present disclosure relates to a method for switching a display mode, and in particular, to a method for changing a landscape signal of a liquid crystal screen to a portrait mode.

BACKGROUND

The construction of existing liquid crystal display (LCD) is that a liquid crystal cell is placed in two parallel glass substrates, a thin film transistor (TFT) is disposed on the lower substrate glass, a color filter is disposed on the upper substrate glass, the direction of rotation of liquid crystal molecules is controlled by a signal and voltage change on the TFT, so as to achieve the display purpose.

Accompanied by the increasing demand for high-quality small-sized single-chip LCD projectors in the home market, especially to satisfy 1920×1080 (commonly known as 1080P) and 1280×720 (commonly known as 720P) high definition displays whilst taking into account the overall balance between projector volume reduction and performance improvement, 600×1024 and 720×1280 resolution full-color LCDs are generally used as image display devices, and 4 inches, 4.2 inches or 4.3 inches are generally selected as the LCD size. The resolution and size are also specifications commonly used by smart mobile phones, and then have become preferred choices for the design of small home projectors.

Taking a 720P (720×1080) resolution 4, 4.2, or 4.3-inch LCD as an example (same for 600×1024 resolution), the 720P resolution LCD screen itself is a portrait while projection output pictures are landscapes, mobile phone screens commonly use the mobile industry processor interface (MIPI) signal interface to transmit images while commonly used projector video processing chips do not support portrait display and MIPI, which is the problem of this technical solution and constitutes the biggest difficulty of applying the mobile phone screen to small projectors. The existing solution is for use on mobile phones, namely, utilizes the portrait to landscape conversion function of Android-based hardware and software systems, but the cost of software and hardware with an operating system is very high. It is necessary to find an economical and practical solution to implement this image rotation function.

SUMMARY

The purpose of the present disclosure is to overcome the above shortcomings in the prior art and provide a method for changing the display mode of a liquid crystal display.

In order to achieve the above-mentioned purpose, the present disclosure provides a method for changing the display mode of a liquid crystal screen, including a liquid crystal display (LCD) terminal, comprising the following steps:

(1) adjusting the setting of a built-in driving time controller (TCON) IC (chipset) of the LCD so as to change the input signal interface of the LCD from the MIPI (mobile industry processor interface) to the transistor-transistor level (TTL) data/timing+serial peripheral interface (SPI) command control interface;

(2) controlling the initialization, turning-on and turning-off of the driving TCON IC via the SPI command control interface, and realizing the switching among four projection modes, desktop front projection, desktop rear projection, ceiling front projection, and ceiling rear projection, by adjusting the up, down, left and right display directions of a screen output image;

(3) receiving, in real time, the landscape image outputted by a front-end video processing chip through the TTL data interface, and then displaying same in real time.

The principle thereof is as follows: by modifying the setting of the driving IC of the LCD screen, the arrangement of the data of the received image when written into the internal data storage random access memory (RAM) of the screen driving IC is changed, and an original landscape image signal is transformed into a data structure suitable for a portrait mobile phone, thereby implementing the conversion from a landscape image to a mobile phone portrait image, and when a 720P LCD screen is placed horizontally, the complete projected image is displayed. Otherwise, the image of the video processing single-chip microcomputer is directly transmitted to the 720P LCD screen, and only a 720×720 area can be displayed instead of the complete 1280×720 resolution image.

According to one embodiment, the method of the present disclosure further includes an algorithm correction step for diagonal tangent line abnormality display, the step being specifically as follows:

adjusting the signal synchronization control of the TCON driving IC of the LCD screen and the synchronization and effective transmission time of the image outputted by the video processing single chip microcomputer, forcibly separating the image data writing time and reading display time of the internal data storage RAM of the screen driving IC, when the image outputted by the video processing single chip microcomputer becomes a complete field of image, stopping image data writing, letting the screen start reading and displaying, and upon the completion of the displaying of a field of image, starting the writing of a new field of image, performing the cycle.

As the arrangement of the data of the received image when written into the internal data storage RAM of the TCON driving IC of the LCD screen has been changed, the original landscape image is converted into a portrait image, which will cause the problem that image data is not synchronized in sequence among being written, read out and displayed, thereby resulting in the case when a motion picture is currently displayed, a part of the picture is still a previous field of image while the other part is the new field of image, and the difference between the two fields of image will lead to an obvious boundary which appears as a diagonal tangent line. By changing the signal synchronization control of the TCON driving IC of the LCD screen and the synchronization and effective transmission time setting of the image outputted by the video processing single chip microcomputer, the image data writing time and reading display time of the internal data storage RAM of the screen driving IC are forcibly separated. When the image outputted by the video processing microcomputer becomes a complete field image, the image data writing is stopped, the screen starts reading and displaying, and upon the completion of the displaying of a field of image, the writing of a new field of image starts, and the cycle goes on. The integrity of the displayed image is guaranteed, avoiding the diagonal tangent line phenomenon which is caused when displaying a motion picture due to the unsynchronized data writing and reading.

According to one embodiment, the method of the present disclosure further includes an algorithm correction step for image interference and flickering abnormality display, the step being as follows:

reducing the vertical refresh frequency of the image outputted by the video processing chip, reducing the data transmission rate, so as to satisfy the rate bandwidth limit condition of a TTL signal line, avoiding the display image interference and flicker caused by data errors during image data transmission.

As the originally synchronized image output by the video processing single chip microcomputer and image display on the screen are forcibly separated chronologically, the transmission rate of the image data being transmitted on the TTL data transmission line is more than doubled, while the data transmission rate supported by the TTL signal line itself is relatively low, and because the forced modification reduces the vertical refresh frequency of the image outputted by the video processing chip (VSync) and reduces the data transmission rate, so as to satisfy the rate bandwidth limit conditions of the TTL signal line, the display image interference and flicker caused due to data errors during image data transmission are avoided.

According to one embodiment, the step (1) of the present disclosure is specifically as follows: setting the configuration pin IM2-0 of the driving IC to 100, configuring the interface to be the Red-Green-Blue (RGB)+ SPI, instead of the corresponding MIPI (mobile industry processor interface) in the case of 110, thereby changing the input signal interface of the LCD from the MIPI to the TTL data/timing interface+ SPI command control interface.

According to one embodiment, the step (2) of the present disclosure is specifically as follows: controlling the initialization, turning-on and turning-off of the driving TCON IC by means of the SPI, that is, initializing the screen state at the time of booting; after the initialization is completed, waiting until the front-end input image signal is normal and stable, turning on the displaying of the screen; when shutting down, first turning off the image display, thereafter turning off the screen, and then realizing the switching among four projection modes, desktop front projection, desktop rear projection, ceiling front projection, and ceiling rear projection, by adjusting the up, down, left and right display directions of the screen output image; that is, controlling, by means of the MX and MY data bits on the register 0x36H of the driving IC, the data writing order in horizontal and vertical directions of the screen, and controlling the flipping of the projection direction, specifically as follows: when the MX value is 0, displaying in a positive order in a horizontal direction; when the MX value is 1, displaying in a reverse order in a horizontal direction; when the MY value is 0, displaying in a positive order in a vertical direction; when the MY value is 1, displaying in a reverse order in a vertical direction.

The present disclosure also provides an LCD projection device including a LCD terminal, the LCD terminal including:

a first unit for adjusting the LCD input interface in the manner of the step (1); a second unit for controlling the driving TCON IC in the manner of the step (2) so as to implement the switching of the projection modes; and a third unit for outputting the image in the manner of the step (3).

According to one embodiment, the device according to the present disclosure further includes a correction unit for a diagonal tangent line abnormality display.

According to one embodiment, the device of the present disclosure further includes a correction unit for image interference and flickering abnormality display.

Compared with the prior art, the present disclosure has the following beneficial effect that by modifying the settings of the TCON IC of the LCD (liquid crystal display), the MIPI input interface is directly changed to the commonly used TTL signal level landscape signal on a portrait LCD (liquid crystal display). This method is the most convenient and has the lowest cost.

Compared with the traditional MIPI solution, in the present disclosure, the chip for the signal conversion from the other video interface to the MIPI is cancelled, and the image outputted by the video processing chip is rotated by 90 degrees, thereby eliminating the special chip or field-programmable gate array (FPGA) chip adapted to the image processing of the LCD portrait screen, which greatly saves cost and printed circuit board (PCB) space, and also reduces production difficulty.

BRIEF DESCRIPTION OF THE DRAWINGS

FIG. 1 is a diagram of parameters before and after the modification of the settings of the driving TCON IC described in the present disclosure.

DETAILED DESCRIPTION OF THE EMBODIMENTS

The present disclosure will be further described in detail below in conjunction with experimental examples and specific embodiments. However, it should not be understood that the scope of the above subject matter of the present disclosure is limited to the following embodiments, and any technology implemented based on the content of the present disclosure falls within the scope of the present disclosure.

Embodiment 1

A method for changing the display mode of a liquid crystal screen, including an LCD terminal, comprising the following steps:

(1) adjusting the setting of a built-in driving TCON IC of the LCD so as to change the input signal interface of the LCD from the MIPI to the TTL data/timing+SPI command control interface;

(2) controlling the initialization, turning-on and turning-off of the driving TCON IC via the SPI, and realizing the switching among four projection modes, desktop front projection, desktop rear projection, ceiling front projection, and ceiling rear projection, by adjusting the up, down, left and right display directions of a screen output image;

(3) receiving, in real time, the landscape image outputted by a front-end video processing chip through the TTL data interface, and then displaying same in real time.

Embodiment 2

A method for changing the display mode of a liquid crystal screen, including an LCD terminal, comprising the following steps:

(1) adjusting the setting of a built-in driving TCON IC of the LCD so as to change the input signal interface of the LCD from the MIPI to the TTL data/timing+SPI command control interface;

(2) controlling the initialization, turning-on and turning-off of the driving TCON IC via the SPI, and realizing the switching among four projection modes, desktop front projection, desktop rear projection, ceiling front projection, and ceiling rear projection, by adjusting the up, down, left and right display directions of a screen output image;

(3) receiving, in real time, the landscape image outputted by a front-end video processing chip through the TTL data interface, and then displaying same in real time.

The method of the present disclosure further includes an algorithm correction step for diagonal tangent line abnormality display, the step being specifically as follows:

adjusting the signal synchronization control of the TCON driving IC of the LCD screen and the synchronization and effective transmission time of the image outputted by the video processing single chip microcomputer, forcibly separating the image data writing time and reading display time of the internal data storage RAM of the screen driving IC, when the image outputted by the video processing single chip microcomputer becomes a complete field of image, stopping image data writing, letting the screen start reading and displaying, and upon the completion of the displaying of a field of image, starting the writing of a new field of image, performing the cycle.

As the arrangement of the data of the received image when written into the internal data storage RAM of the TCON driving IC of the LCD screen has been changed, the original landscape image is converted into a portrait image, which will cause the problem that image data is not synchronized in sequence among being written, read out and displayed, thereby resulting in the case when a motion picture is currently displayed, a part of the picture is still a previous field of image while the other part is the new field of image, and the difference between the two fields of image will lead to an obvious boundary which appears as a diagonal tangent line. By changing the signal synchronization control of the TCON driving IC of the LCD screen and the synchronization and effective transmission time setting of the image outputted by the video processing single chip microcomputer, the image data writing time and reading display time of the internal data storage RAM of the screen driving IC are forcibly separated. When the image outputted by the video processing microcomputer becomes a complete field image, the image data writing is stopped, the screen starts reading and displaying, and upon the completion of the displaying of a field of image, the writing of a new field of image starts, and the cycle goes on. The integrity of the displayed image is guaranteed, avoiding the diagonal tangent line phenomenon which is caused when displaying a motion picture due to the unsynchronized data writing and reading.

The method of the present disclosure further includes an algorithm correction step for image interference and flickering abnormality display, the step being as follows:

reducing the vertical refresh frequency of the image outputted by the video processing chip, reducing the data transmission rate, so as to satisfy the rate bandwidth limit condition of a TTL signal line, avoiding the display image interference and flicker caused by data errors during image data transmission.

As the originally synchronized image output by the video processing single chip microcomputer and image display on the screen are forcibly separated chronologically, the transmission rate of the image data being transmitted on the TTL data transmission line is more than doubled, while the data transmission rate supported by the TTL signal line itself is relatively low, and because the forced modification reduces the vertical refresh frequency of the image outputted by the video processing chip (VSync) and reduces the data transmission rate, so as to satisfy the rate bandwidth limit conditions of the TTL signal line, the display image interference and flicker caused due to data errors during image data transmission are avoided.

The step (1) of the present disclosure is specifically as follows: setting the configuration pin IM2-0 of the driving IC to 100, configuring the interface to be the RGB+ SPI, instead of the corresponding MIPI in the case of 110, thereby changing the input signal interface of the LCD from the MIPI interface to the TTL data/timing+SPI command control interface.

The step (2) of the present disclosure is specifically as follows: controlling the initialization, turning-on and turning-off of the driving TCON IC by means of the SPI interface, that is, initializing the screen state at the time of booting; after the initialization is completed, waiting until the front-end input image signal is normal and stable, turning on the displaying of the screen; when shutting down, first turning off the image display, thereafter turning off the screen, and then realizing the switching among four projection modes, desktop front projection, desktop rear projection, ceiling front projection, and ceiling rear projection, by adjusting the up, down, left and right display directions of the screen output image; that is, controlling, by means of the MX and MY data bits on the register 0x36H of the driving IC, the data writing order in horizontal and vertical directions of the screen, and controlling the flipping of the projection direction, specifically as follows: when the MX value is 0, displaying in a positive order in a horizontal direction; when the MX value is 1, displaying in a reverse order in a horizontal direction; when the MY value is 0, displaying in a positive order in a vertical direction; when the MY value is 1, displaying in a reverse order in a vertical direction.

Embodiment 3

An LCD projection device comprising an LCD terminal, the LCD terminal comprising:

a first unit for adjusting the LCD input interface in the manner of the step (1) of the method in Embodiment 1; a second unit for controlling the driving TCON IC in the manner of the step (2) of the method in Embodiment 2 so as to implement the switching of the projection modes; and a third unit for outputting the image in the manner of the step (3) of the method in Embodiment 1.

The device according to the present disclosure further includes a correction unit for a diagonal tangent line abnormality display.

The device of the present disclosure further includes a correction unit for image interference and flickering abnormality display.

The foregoing descriptions are merely embodiments of the present disclosure and are not intended to limit the present disclosure. Any modification, equivalent replacement and improvement made within the spirit and principle of the present disclosure shall be included in the protection of the present disclosure.

What is claimed is:

1. A method for changing display mode of a liquid crystal screen including a liquid crystal display (LCD) terminal, the method comprising:

(1) adjusting a setting of a built-in driving time controller (TCON) chipset (IC) of LCD to change an input signal interface of the LCD from a mobile industry processor interface (MIPI) to a transistor-transistor level (TTL) data interface+serial peripheral interface (SPI) command control interface;

(2) controlling initialization, turning-on and turning-off of the driving TCON IC) via the SPI, and realizing switching among four projection modes including desktop front projection, desktop rear projection, ceiling front projection, and ceiling rear projection, by adjusting up, down, left and right display directions of a screen output image;

(3) receiving, in real time, a landscape image outputted by a front-end video processing chip through the TTL data interface, and then displaying same in real time.

2. The method for changing display mode of a liquid crystal screen according to claim 1, further comprises an algorithm correction step for the diagonal tangent line abnormality display, the step comprising:

adjusting a signal synchronization control of a TCON driving chipset IC of the LCD screen and a synchronization and effective transmission time of an image outputted by a video processing single chip microcomputer, forcibly separating an image data writing time and a reading display time of an internal data storage random access memory (RAM) of the TCON driving IC, when the image outputted by the video processing single chip microcomputer becomes a complete field of image, stopping image data writing, letting the screen start reading and displaying, and upon the completion of the displaying of the complete field of image, starting writing of a new field of image, repeating the above steps.

3. The method for changing display mode of a liquid crystal screen according to claim 1, further comprises an algorithm correction step for image interference and flickering abnormality display, the step comprising:

reducing a vertical refresh frequency of the image outputted by the video processing chip, reducing a data transmission rate to satisfy a rate bandwidth limit condition of a TTL signal line, avoiding the image interference and flickering caused by data errors during image data transmission.

4. The method for changing display mode of a liquid crystal screen according to any one of claim 1, wherein the step (1) comprises: setting a configuration pin IM2-0 of the driving IC to 100, configuring the interface to be a Red-Green-Blue (RGB)+SPI interface, instead of the corresponding MIPI in the case of 110, changing the input signal interface of the LCD from the MIPI to the TTL data interface+SPI command control interface.

5. The method for changing display mode of a liquid crystal screen according to any one of claim 1, wherein the step (2) comprises: controlling the initialization, turning-on and turning-off of the TCON IC by means of the SPI interface, that is, initializing the screen state at a time of booting; after the initialization is completed, waiting until a front-end input image signal is normal and stable, turning on the displaying of the screen; when shutting down, first turning off the image display, thereafter turning off the screen, and then realizing the switching among the four projection modes including the desktop front projection, the desktop rear projection, the ceiling front projection, and the ceiling rear projection, by adjusting the up, down, left and right display directions of the screen output image, that is, controlling, by means of MX and MY data bits on the register 0x36H of the driving IC, a data writing order in horizontal and vertical directions of the screen, and controlling the flipping of the projection direction as follows: when the MX value is 0, displaying in a positive order in a horizontal direction; when the MX value is 1, displaying in an inverted order in a horizontal direction; when the MY value is 0, displaying in a positive order in a vertical direction; when the MY value is 1, displaying in an inverted order in a vertical direction.

6. A liquid crystal display (LCD) projection device including a LCD terminal, wherein the LCD terminal comprises:

a first unit for adjusting a setting of a built-in driving time controller (TCON) chipset (IC) of the LCD to change an input signal interface of the LCD from a mobile industry processor interface (MIPI) to a transistor-transistor level (TTL) data interface+serial peripheral interface (SPI) command control interface;

a second unit for controlling initialization, turning-on and turning-off of the driving TCON IC via the SPI command control interface, and realizing switching among four projection modes including desktop front projection, desktop rear projection, ceiling front projection, and ceiling rear projection, by adjusting up, down, left and right display directions of a screen output image; and a third unit for receiving, in real time, a landscape image outputted by a front-end video processing chip through the TTL data interface, and then displaying same in real time.

7. The LCD projection device according to claim 6, further comprises a correction unit for a diagonal tangent line abnormality display.

8. The LCD projection device according to claim 6, further comprises a correction unit for image interference and flickering abnormality display.

* * * * *